United States Patent [19]

Powers

[11] 4,176,272

[45] Nov. 27, 1979

[54] MOS-BIPOLAR PRINTER DRIVER CIRCUIT

[75] Inventor: Vernon B. Powers, St. Petersburg, Fla.

[73] Assignee: E-Systems, Inc., Dallas, Tex.

[21] Appl. No.: 848,336

[22] Filed: Nov. 3, 1977

[51] Int. Cl.[2] ..... H05B 1/00

[52] U.S. Cl. ..... 219/216; 219/543; 307/251; 307/270; 307/304; 346/76 R

[58] Field of Search ..... 219/216, 388, 543; 346/76 R; 307/251, 253, 270, 304, 310; 357/41, 43, 28

[56] References Cited

U.S. PATENT DOCUMENTS

| | | | |
|---|---|---|---|
| 3,299,329 | 1/1967 | Pollock | 357/43 |
| 3,874,493 | 4/1975 | Boyd | 219/216 X |
| 3,921,162 | 11/1975 | Fukai et al. | 219/216 |
| 3,967,139 | 6/1976 | Johnson et al. | 307/270 |
| 3,973,111 | 8/1976 | Washizuka et al. | 219/216 |
| 3,975,742 | 8/1976 | Kelley | 219/216 X |
| 3,991,329 | 11/1976 | Iwasa et al. | 307/304 |
| 4,000,411 | 12/1976 | Sano et al. | 307/205 |
| 4,008,406 | 2/1977 | Kawagoe | 307/304 |
| 4,063,117 | 12/1977 | Lougesen et al. | 307/251 X |

*Primary Examiner*—C. L. Albritton
*Attorney, Agent, or Firm*—Robert V. Wilder

[57] ABSTRACT

In a thermal printer, a print element drive circuit has connected in series a CMOS (Complementary Metal Oxide Semiconductor) inverter gate driving a MOS (Metal Oxide Semiconductor) transistor which in turn drives a bipolar power transistor. The bipolar power transistor provides current pulses to a resistive element which is thermally activated in response to the pulses to cause the printing of characters upon thermal sensitive paper. Character decoding circuitry provides high impedence logic level inputs to the CMOS inverter and these inputs are converted by the printer driver circuitry into corresponding high current drive pulses.

9 Claims, 2 Drawing Figures

MOS-BIPOLAR PRINTER DRIVER CIRCUIT

BACKGROUND OF THE INVENTION

The present invention relates to thermal printers and more particularly to a drive circuit for amplifying logic level signals into high current pulses.

In prior art thermal print drivers, a DTL (Diode Transistor Logic) gate is used in a circuit to drive a complementary bipolar transistor pair which provides current to a resistive heating element. This circuit suffers from disadvantages in that it consumes an excessive amount of power and looses significant power handling capability at lower temperatures. It also has a relatively low overall power output which causes the system to print at a comparatively slow rate of speed due to the time required to provide sufficient power to heat the thermal printing element. Therefore, there is a need for a printer driver circuit which overcomes these problems.

In a thermal printer, an electrical current is supplied to a resistive heating element which is in contact with thermal sensitive paper. When the element is heated by the current, it forms a dot on the paper. For high speed operation of the printer, the heating element must be supplied with a high current pulse to rapidly heat the element and cause a dot to be printed on the paper. The resistive heating element must have a relatively low thermal time constant so that it cools quickly and does not produce a smeared impression on the paper. Therefore, for optimum operation, the heating element must be supplied with a high, but short time period, current pulse.

A thermal printer heating element prints a series of dots in order to form characters on the thermal sensitive paper. The commands to print the dots are generated by digital logic circuitry, primarily CMOS logic which is widely used due to its low cost and low power consumption. However, the output of a CMOS logic is a relatively low voltage, high impedance signal which must be substantially amplified to provide sufficient current to the resistive heating element. In addition, the drive circuit must be relatively insensitive to temperature changes in order to meet military temperature specification requirements.

In accordance with the present invention there is provided a thermal print driver circuit which provides a heavy current driver pulse, as much as several amps, in response to a CMOS logic level signal, has a rapid rise time, and continues to supply high current pulses even at extremely low temperatures.

SUMMARY OF THE INVENTION

In accordance with the present invention there is provided a thermal print driver circuit in which a series of semiconductor elements are disposed on a substrate. A CMOS inverter receives a logic level signal and inverts it to drive an MOS transistor. The MOS transistor in turn drives a bipolar transistor also mounted on the same substrate. A resistor is disposed between a first terminal of the MOS transistor and a direct current voltage source. A second terminal of the MOS transistor is grounded. The emitter of the bipolar transistor is connected to a thermal printer resistive heating element in the thermal printer. Thus, when high logic level signals are applied to the CMOS inverter, the bipolar transistor is turned on to supply a high amplitude output current to the thermal printer resistive element. Inversely, when a low level signal is supplied to the CMOS inverter, the bipolar transistor is turned off and no current flows to the thermal print element.

BRIEF DESCRIPTION OF THE DRAWINGS

For a more complete understanding of the present invention and the advantages thereof, reference is now made to the following description taken in conjunction with the accompanying drawings.

DETAILED DESCRIPTION OF THE INVENTION

Figure 1:
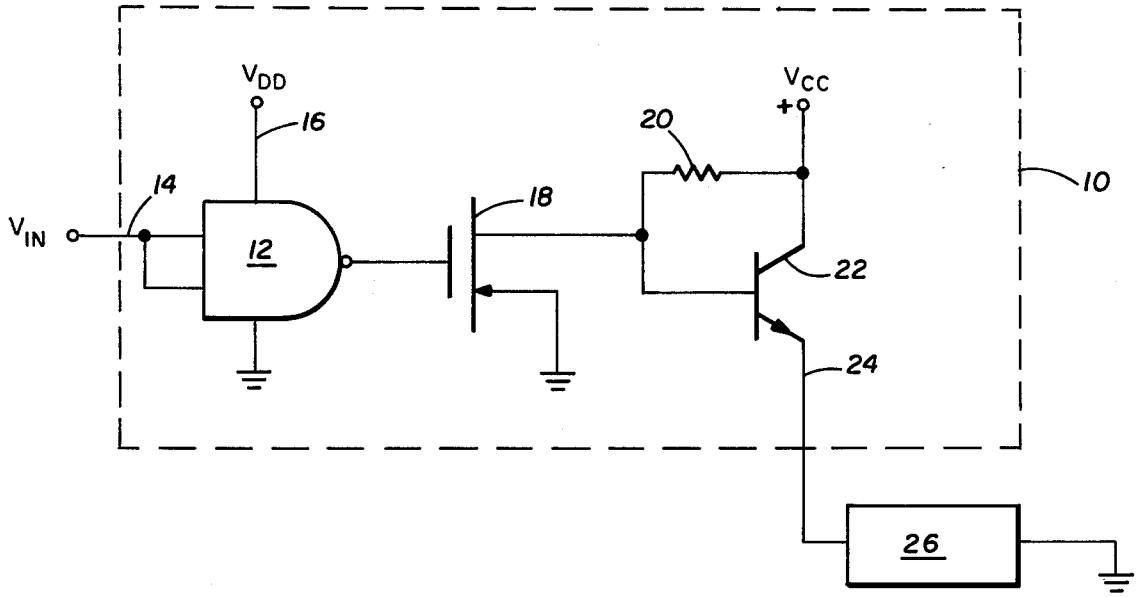
FIG. 1 is a schematic diagram of the preferred embodiment of the present invention.

A schematic diagram of the present invention is shown in FIG. 1. A substrate 10 provides a base of the mounting of the various circuit components. A CMOS NAND logic gate 12 is mounted on the substrate 10 and has an input logic line 14 supplied with binary logic signals. The two inputs to the CMOS gate 12 are tied together thus making the gate function as an inverter. A direct current power source ($V_{DD}$) is provided to the CMOS gate 12 on line 16.

The inverted output of the NAND gate 12 is transmitted to the gate input of an N-channel MOS transistor 18. The source terminal of MOS transistor 18 is connected to ground and the drain terminal is connected through a resistor 20 to a direct current voltage supply ($V_{cc}$) and to the base of a bipolar NPN transistor 22. Both the N-channel MOS transistor 18 and the bipolar transistor 22 are chips which are mounted on the substrate 10.

The collector of bipolar transistor 22 is connected to the voltage source $V_{cc}$ and the emitter is connected through a line 24 to a resistive load 26. The resistive load 26 is the resistive heating element in the thermal printing system. This resistive load can be either a single resistive element or a multielement variable resistive load with logic to select varying elements that are to be heated dependent upon the character selected. In the multielement resistive load, the resistance typically varies between 8 and 40 ohms as determined by the number of elements heated.

In operation, when it is desired to print a dot on a thermal sensitive paper in contact with the heating element, a high logic level signal is supplied on line 14 to the NAND gate 12. This gate then provides a low level signal to the gate of the N-channel transistor 18, thereby turning the transistor off. In this state the base of bipolar transistor 22 has a turn on voltage applied therefore turning this transistor on and supplying current to the resistive load 26. This load then becomes hot and causes a dot to be printed on the thermal sensitive paper.

When the input to the NAND gate 12 is low, a high level signal is provided to the gate of the N-channel MOS transistor 18. This high signal turns the N-channel MOS transistor on, which effectively grounds the base of the bipolar transistor 22, thereby turning it off, and no current is supplied to the resistive load 26. Thus, the bipolar transistor 22 is turned on when a high logic level signal is supplied to NAND gate 12 and turned off when a low logic level signal is supplied to the input of this gate.

The NAND gate 12 functions only as an inverter. If the driving logic is designed such that an opposite level is used to indicate that a dot should be printed, then the gate 12 can be omitted and the logic level signal supplied directly to the gate of the N-channel MOS transistor 18.

The N-channel MOS transistor 18 offers a very high input impedance to the logic drive circuit and provides substantial power for activating the bipolar transistor 22. With existing technology, the preferred embodiment of the present invention is a hybrid circuit in which previously manufactured semiconductor chips are mounted on a single substrate.

The N-channel MOS transistor 18 and the bipolar transistor 22 have unique temperature characteristics which make possible operation of the printer driver circuit at extremely low temperatures. With an all bipolar circuit, as in the prior art, drive current is substantially reduced at low temperatures. However, the N-channel MOS transistor 18 has a temperature characteristic compatible with that of the bipolar transistor. Therefore, as the temperature becomes lower the bipolar transistor tends to produce less current while the N-channel MOS transistor 18 tends to raise the bias on the base of the bipolar transistor to increase current flow; the transistor pair compensates for the temperature characteristics of each component and provides a circuit which generates sufficient current for thermal printing at very low temperatures.

Circuit components for the present invention as constructed for a working model include an RCA Model CD4011 integrated circuit chip for the CMOS NAND gate 12, a VMP-11 chip by Siliconix for the N-channel MOS transistor 18, and a Model SSP0204N bipolar NPN transistor 22 manufactured by Semiconductor Services, Inc. These operate with a 12 volt power source ($V_{cc}$).

Resistor 20 can be either screened and deposited on the substrate 10 or it may be a discrete resistive element which is joined to the substrate 10 and lead bonded to the other circuit components. A representative impedance for this resistor is 100 ohms.

Figure 2:
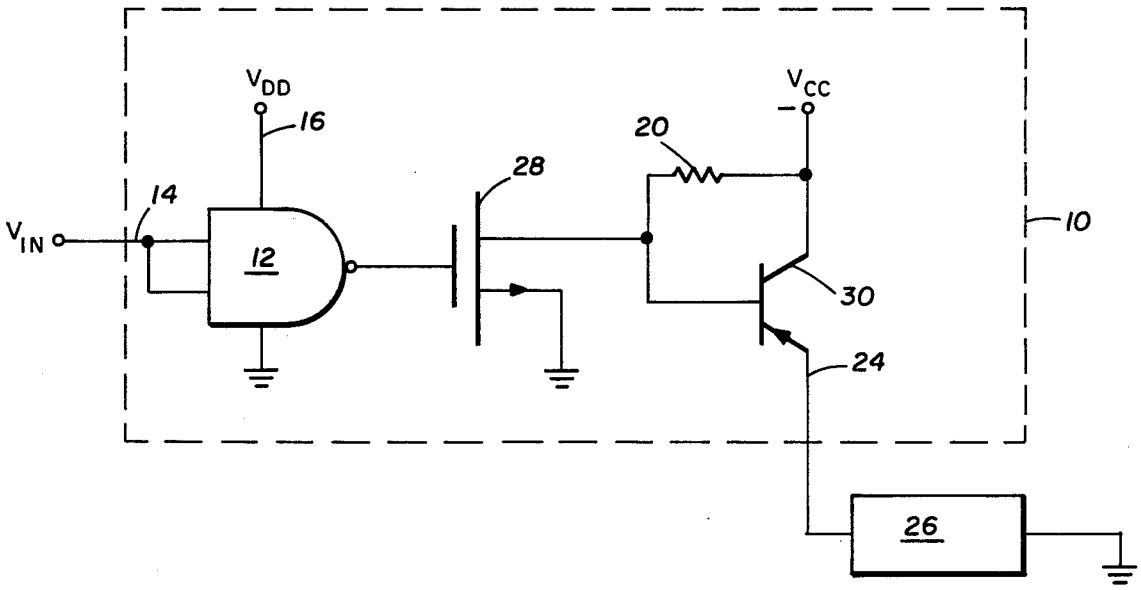
FIG. 2 is a schematic diagram of an alternate embodiment of the present invention.

A second embodiment of the present invention is illustrated in FIG. 2. This circuit is similar to that shown in FIG. 1 with the exceptions that N-channel MOS transistor 18 has been replaced by P-channel MOS transistor 28 and NPN bipolar transistor 22 has been replaced by PNP bipolar transistor 30. In addition, the power supply polarity for the two transistors has been changed from positive to negative.

The operation of the embodiment shown in FIG. 2 is as follows. A high input level on logic line 14 is inverted by NAND gate 12 which turns on the MOS transistor 28. This grounds the base of bipolar transistor 30 thus turning it off and preventing the flow of current to resistive load 26. A low level input on logic line 14 produces a high level input to MOS transistor 28 thereby turning it off. This supplies a negative voltage to the base of bipolar transistor 30 thus turning it on and providing current to the resistive load 26.

Thus, in accordance with the present invention there is provided a thermal print driver circuit which provides a substantial drive current in response to a logic level signal and is capable of supplying such current even at extremely low temperatures.

Although several embodiments of the invention has been illustrated in the accompanying drawings and described in the foregoing detailed description, it will be understood that the invention is not limited to the embodiments disclosed, but is capable of numerous rearrangements, modifications and substitutions without departing from the scope of the invention.

What is claimed is:

1. A thermal printer driver circuit connected to a thermal printer resistive heating element comprising:

an MOS transistor having a binary input signal provided to the gate terminal thereof and having a first terminal grounded, a resistor connected between a second terminal of said MOS transistor and a voltage source, and a bipolar transistor having the base terminal thereof connected to said second terminal of said MOS transistor, the collector terminal thereof connected to said voltage source and the emitter terminal thereof connected to the thermal printer resistive heating element.

2. A thermal printer driver circuit as recited in claim 1 wherein said MOS transistor is a N-channel device and said bipolar transistor is an NPN device.

3. A thermal printer driver circuit as recited in claim 1 wherein said MOS transistor is a P-channel device and said bipolar transistor is a PNP device.

4. A thermal printer driver circuit as recited in claim 1 including a CMOS inverter generating said binary input signal supplied to the gate terminal of said MOS transistor.

5. A thermal printer driver circuit as recited in claim 1 wherein said MOS transistor and said bipolar transistor are semiconductor chips mounted on a substrate.

6. A thermal printer driver circuit as recited in claim 1 wherein said resistor is deposited on said substrate.

7. A thermal printer driver circuit as recited in claim 1 wherein said resistor is a component attached to said substrate.

8. A hybrid thermal printer for producing visible impressions on thermal sensitive paper, comprising:

an MOS transistor mounted on a substrate, said transistor having a binary input signal provided to the gate terminal and having a first terminal grounded, a first resistor connected between a second terminal of said MOS transistor and a voltage source, a bipolar transistor mounted on said substrate, said bipolar transistor having a base terminal connected to said second terminal of said MOS transistor and having a collector terminal connected to said voltage source, and a resistive heating element having a first terminal connected to the emitter terminal of said bipolar transistor and a second terminal thereof grounded.

9. A hybrid thermal printer as recited in claim 7 including a CMOS inverter disposed on said substrate and generating said binary input signal supplied to the gate terminal of said MOS transistor.

* * * * *